US009981270B2

(12) United States Patent
Haase

(10) Patent No.: US 9,981,270 B2
(45) Date of Patent: May 29, 2018

(54) GRINDING MACHINE

(71) Applicant: GBF Gesellschaft Fuer Bemessungsforschung MBH, Aachen (DE)

(72) Inventor: Ralf Haase, Aachen (DE)

(73) Assignee: GBF Gesellschaft Fuer Bemessungsforschung MBH, Aachen (DE)

( * ) Notice: Subject to any disclaimer, the term of this patent is extended or adjusted under 35 U.S.C. 154(b) by 426 days.

(21) Appl. No.: 14/615,850

(22) Filed: Feb. 6, 2015

(65) Prior Publication Data

US 2015/0238973 A1 Aug. 27, 2015

Related U.S. Application Data

(63) Continuation of application No. PCT/EP2013/067393, filed on Aug. 21, 2013.

(30) Foreign Application Priority Data

Aug. 22, 2012 (DE) ..... 10 2012 107 740

(51) Int. Cl.

| | |
|---|---|
| ***B02C 15/00*** | (2006.01) |
| ***B02C 25/00*** | (2006.01) |
| ***B02C 4/02*** | (2006.01) |
| ***B02C 15/02*** | (2006.01) |
| ***B02C 15/04*** | (2006.01) |
| ***B02C 23/10*** | (2006.01) |

(52) U.S. Cl.

CPC ..... *B02C 25/00* (2013.01); *B02C 4/02* (2013.01); *B02C 15/007* (2013.01); *B02C 15/02* (2013.01); *B02C 15/04* (2013.01); *B02C 23/10* (2013.01)

(58) Field of Classification Search

CPC ..... B02C 25/00
USPC ..... 241/33–34, 37, 117, 119
See application file for complete search history.

(56) References Cited

U.S. PATENT DOCUMENTS 8,109,458 B2 * 2/2012 Hanghoj ..... B02C 15/007 241/117
9,457,353 B2 * 10/2016 Dunst ..... B02C 15/007
(Continued)

FOREIGN PATENT DOCUMENTS

| | | |
|---|---|---|
| DE | 102007062820 | 8/2009 |
| DE | 102009031429 | 1/2011 |
| WO | WO2010113119 | 10/2010 |

*Primary Examiner* — Faye Francis
(74) *Attorney, Agent, or Firm* — Von Rohrscheidt Patents

(57) ABSTRACT

A method for grinding a grinding material in a mill including a grinding body and at least one roller which rolls on the grinding body under a grinding pressure, wherein the grinding material is fed in a stream of grinding material, forms a grinding bed between the grinding body and the roller and is crushed in the grinding bed by the roller, wherein a grinding bed height of the grinding bed between the grinding body and the roller is continuously measured, and wherein the mill is controlled based on control variables to achieve a predetermined nominal condition, wherein the control variables include at least the grinding pressure and the stream of the grinding material and the nominal condition includes at least one nominal value for the grinding bed height, wherein a mechanical condition of the roller and therefrom a stability of the grinding bed are continuously determined.

11 Claims, 2 Drawing Sheets

(56) References Cited

U.S. PATENT DOCUMENTS

| | | | | |
|---|---|---|---|---|
| 2010/0200684 | A1* | 8/2010 | Hanghoj | B02C 15/007<br>241/114 |
| 2014/0209719 | A1* | 7/2014 | Dunst | B02C 25/00<br>241/25 |
| 2015/0014452 | A1* | 1/2015 | Assmann | B02C 15/00<br>241/15 |

* cited by examiner

GRINDING MACHINE

RELATED APPLICATIONS

This application is a continuation of International application PCT/EP2013/067393 filed on Aug. 21, 2013 claiming priority from German application 10 2012 107 740.1 filed on Aug. 22, 2012, both of which are incorporated in their entirety by this reference.

FIELD OF THE INVENTION

The invention relates to a method for grinding a product in a mill.

BACKGROUND OF THE INVENTION

A method of this type is known from DE 10 2007 062 820 A1. Another method of the type recited supra is for example implemented by the control software LMaster of Loesche GmbH, Duesseldorf.

A vertical mill that is controllable by a method of this type is disclosed for example by DE 1 507 579 B. Vertical mills of this type are used in particular in the concrete industry and in coal power plants for grinding brittle material to be ground or grinding material, for example raw meal (as a pre product for concrete production) cement clinker, limestone in general, coal, clay, gypsum or slag sand.

A vertical mill is essentially made form one or plural mills with a rotating grinding plate as a common grinding element and a respective rolling element rolling on the grinding element. The rolling elements can be geometrically configured as spheres or cylindrical, conical or convex rollers. The wearing surfaces of the grinding element and of the rolling element can be provided with highly wear resistant jackets, for example made from chilled cast iron.

During operations of vertical mills the material to be ground is typically applied from above to a center of the grinding element, moves from there under its own weight and through centrifugal forces in a radial outward direction and is ground by the rollers. Thus a layer of partially ground grinding material with different grit sizes is formed on the grinding element. This layer is designated as grinding bed and continuously moves towards the edge of the grinding element and beyond. Depending on grinding material and application water is additionally applied to the grinding element.

At an edge of the grinding element particles of the grinding material fall into a ground material bowl of the vertical mill which ground material bowl is arranged under the grinding element. Depending on the application the particles from the ground material bowl are sifted according to grit sizes, wherein particularly coarse particles are provided to the grinding element again. Quite frequently dust shaped particles are carried out of the grinding bed in upward direction by a vertically rising air flow into a sifter arranged above the grinding element.

A mechanical condition of the grinding bed during rollover, its stability and grinding bed elevation on the grinding element essentially define an effectivity of the grinding process. The known method monitors the grinding bed elevation and fineness and volume of the carried out particles and automatically adapts control variables of the vertical mill when the measured parameters deviate from a defined nominal condition of the vertical mill.

The typical control variables of a vertical mill, the grinding material flow and depending on the application an adjustable grinding pressure on the rollers, a volume of water applied to the grinding element or a volume of the air flow and a sifter speed of rotation are only linked very indirectly and to a large extent in a nonlinear manner with the measured control variables of fineness and volume of the carried out particles. A correct adaptation of the control variables is therefore very complex and error prone.

DE 10 2007 062 820 A1 recited supra proposes for grinding coal to control a grinding bed level with fuzzy rules that are not defined in more detail so that a "rattling" of the mill is prevented. For measurement and control variables sifter air flow, -temperature, -sifted grit size and sifter speed of revolution, grinding material mass flow (the so called "mill load") grinding pressure, grinding bed height, grinding material grinding properties (e.g. Hardgrove number) and storage volume and NOx-emission or a flame image of a burner connected downstream of the mill and a pressure difference between mill inlet and mill outlet of the hot drying air flowing through the mill including the pulled along dried carbon dust particles and the water that is evaporated from the carbon are suggested.

BRIEF SUMMARY OF THE INVENTION

It is an object of the invention to provide a new method for adapting the control variables. Improving upon the known method it is proposed according to the invention that a mechanical condition of a roller is continuously determined during grinding and a stability of the grinding bed is continuously determined therefrom and that the nominal condition includes at least one nominal value for the stability of the grinding bed.

The object is achieved by a method for grinding a product in a mill including a grinding body and at least one roller which rolls on the grinding body under a grinding pressure, wherein the product is fed in a stream of product between the grinding body and the roller so that a grinding bed is formed and the product is crushed in the grinding bed by the roller. During the grinding process, a grinding bed height of the grinding bed between the grinding body and the roller is continuously measured and the mill is controlled by means of control variables to achieve a predefined nominal condition, the control variables including at least the grinding pressure and the stream of product and the nominal condition including at least one nominal value for the grinding bed height.

The known methods are limited to measuring the grinding bed height because the stability of the grinding bed which essentially determines the effectivity of the grinding process is not directly measurable. The invention is based on the finding that the stability of the grinding bed under a roller correlates with a mechanical condition of the roller through the motion equations and that the stability of the grinding bed can thus be calculated from the mechanical condition of the roller. The mechanical condition of the roller, its condition of movement, impacting forces and occurring deformations are measurable by generally known methods.

The method according to the invention provides a control variable for controlling the grinding process with the complete mechanical condition of the grinding bed which has a much more direct relationship with the control variables of the vertical mill. This eventually facilitates an automatic adaptation of the control variables.

Advantageously the mechanical condition of the roller in a method according to the invention includes a force from the grinding bed which force impacts the roller and a location and/or a rotation angle of the roller about a rotation axis of the roller. Advantageously the force and optionally the location of the roller is determined at least in a radial direction according to a method according to the invention. Through the radial components of the force and of the location of the roller stiffness of the grinding bed perpendicular to the grinding element can be determined through the tangential component of the force and a rotation angle in movement direction of the grinding bed.

Particularly advantageously at least one of velocity, acceleration, angular velocity and angular acceleration of the roller is determined in a method according to the invention.

In a particularly advantageous embodiment of the method according to the invention the stability of the grinding bed includes at least a dampening of the grinding bed and/or a stiffness of the grinding bed. By determining the movement components and a force in three directions in space and about the three axes in space all possibly linear independent components are detected for determining stability.

Depending on the application various components of these parameters of the mechanical condition of the roller can be less relevant. In a method according to the invention determining the less relevant components can be omitted accordingly.

Advantageously proportional constants for determining the control variables are determined from the stability of the grinding bed in a method according to the invention for calibration purposes, initially based on measured values by multidimensional nonlinear regression. The calibration of the proportional constants based on measured values facilitates in particular adapting the method according to the invention to various vertical mills.

Particularly advantageously the proportional constants are continuously determined in a method according to the invention during grinding. Since the proportional constants should not change or should only change very slowly during control operations of a mill, their constant monitoring provides a good insight into their condition in particular of the roller. A rapid change of the proportional constants can indicate a malfunction during operations and can be used as a criterion for an automatic emergency shutdown.

In the course of a method according to the invention water can be introduced between the grinding element and the roller together with the grinding material, wherein the control variables include the amount of water that is introduced. Furthermore the ground grinding material can be fed by essentially vertically flowing air into a sifter and can be classified therein according to criteria including at least particle size, density, inertia and flotation or layering properties, wherein the control variables include a volume of flowing air and a sifter speed of the sifter.

BRIEF DESCRIPTION OF THE DRAWINGS

The invention is now described in more detail based on embodiments with reference to drawing figures, wherein.

DETAILED DESCRIPTION OF THE INVENTION

Figure 1:
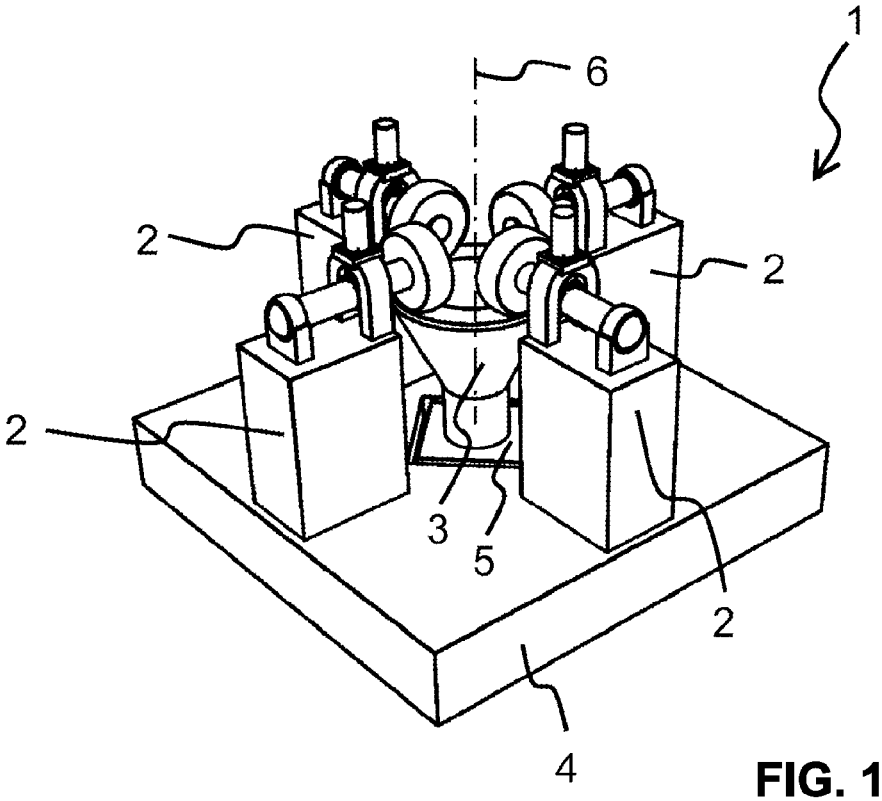
FIG. 1 illustrates a vertical mill.

The vertical mill 1 illustrated in FIG. 1 includes four mills 2 with a grinding plate forming a joint grinding element 3. The four mills 2 and the grinding element 3 are anchored on a common foundation 4. A base plate 5 of the grinding element 3 is fixated at the foundation 4. The grinding element 3 is rotatably supported about a vertical axis 6 and is driven during operation of the vertical mill 1.

Figure 2:
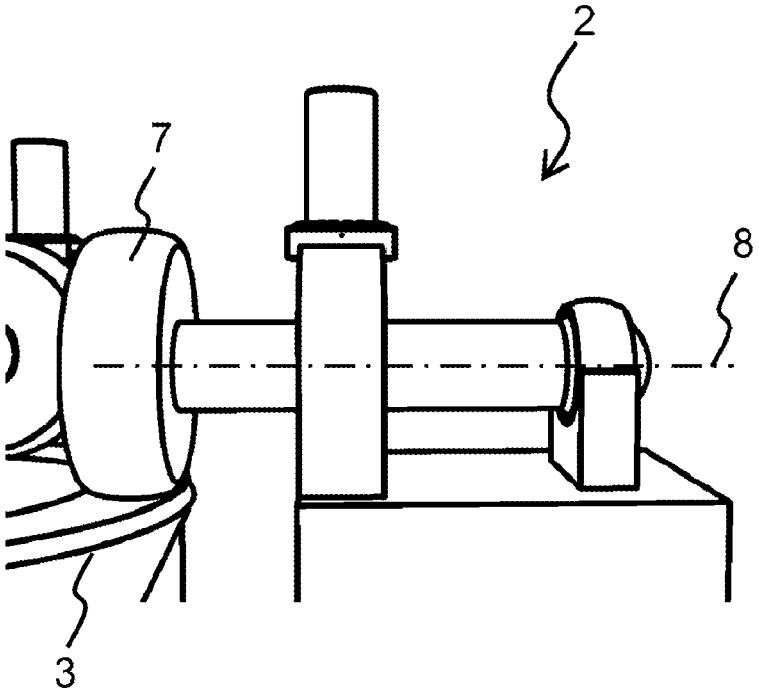
FIG. 2 illustrates a detail of the vertical mill.

FIG. 2 illustrates an individual mill 2 of the vertical mill 1 in detail. Each mill 2 includes a roller 7 which rotates about a horizontal axis 8 and which rolls on the grinding element 3.

Figure 3:
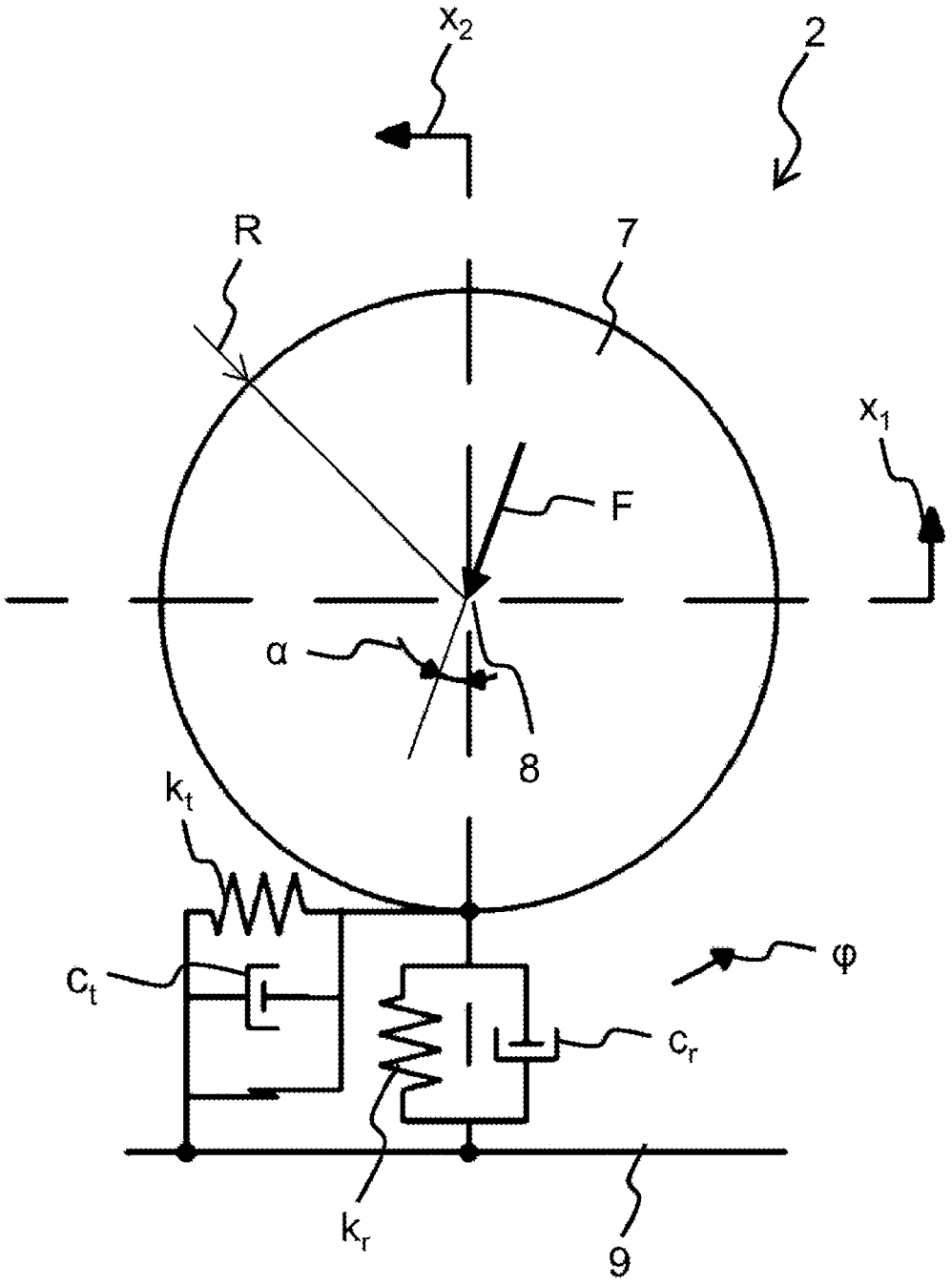
FIG. 3 illustrates a principle drawing with respect to the motion equations.

A mechanical condition of the roller 7 can be mathematically described by the structural dynamic motion equation $F=c\ f(x)+k\ f\ (v)=m\ f\ (a)$ which is illustrated in FIG. 3. The force F impacts the roller 7, the roller 7 has a radius R, a mass m and at any time a distance x from a non illustrated zero point, a velocity v and an acceleration a. The constants k and c of the equation of motion correspond to stiffness and damping of the grinding bed 9. All variables are vector variables. The velocity v and the acceleration a in the idealized contact point with the grinding bed 9 include portions of derivatives of the angle $\varphi$ in a tangential direction.

In the vertical mill a base material for concrete production is ground which includes approximately 90% limestone. Additional additives are in particular clay, carbon dust and aluminum, wherein the latter are put into the vertical mill already in fine grit sizes. Before application the grinding material is heated to approximately 200° C. in order to prevent premature caking. Sensors are initially attached at the mills 2 for continuously determining the mechanical condition of the rollers 7 and the movement and the forces and the control variables grinding bed height, drive power, differential pressure, sifter temperature and heating power and the associated values of grinding pressure, grinding material flow, sifter speed and water and air volume are captured as control variables over several weeks. From the mechanical condition a stability of the grinding bed 9 is continuously calculated through the equation of motion.

In order to calibrate the control the proportional constants are determined by multidimensional non-linear regression wherein the proportional constants describe a relationship between stability of the grinding material 9 and the control variables of the mills 2.

In order to operate the vertical mill 1 a nominal condition of the grinding bed 9 is predetermined wherein the grinding method operates with optimum efficiency at this nominal condition based on experiences of the prior measurement. When the mechanical condition of the grinding bed 9 that is determined from the measured values deviates from the nominal condition during operations a respective adaptation of the control variables is determined with the known mathematical relationship and predetermined in a control of the vertical mill as a nominal value so that the control reestablishes the nominal condition.

During operations of the vertical mill 1 the angle $\alpha$ of the force F is an important measure for energy efficiency of the method.

Another mill type which is suitable for controlling by the method according to the invention is a so called roller mill, wherein the roller rolls on a second roller with identical size and identical circumferential velocity forming a grinding element 3. The grinding material is essentially applied from above into the knuckle between the two rollers is ground and falls down into the ground material bowl.

REFERENCE NUMERALS AND DESIGNATIONS

1 vertical mill
2 mill

3 grinding element
4 foundation
5 base plate
6 axis
7 roller
8 axis
9 grinding bed

What is claimed is:

1. A method for grinding a grinding material in a mill including a grinding body and at least one roller which rolls on the grinding body under a grinding pressure, the method comprising the steps:

feeding the grinding material in a stream to form a grinding bed between the grinding body and the at least one roller and grinding the grinding material in the grinding bed by the at least one roller;

continuously measuring a grinding bed height of the grinding bed between the grinding body and the at least one roller during the grinding;

controlling the mill based on control variables to achieve a nominal condition, wherein the control variables include at least the grinding pressure and the stream of the grinding material and the nominal condition includes at least a nominal value for the grinding bed height; and continuously determining a mechanical condition of the at least one roller which is mathematically described by the structural dynamic motion equation $F=c\ f(x)+k\ f(v)=m\ f(a)$ where F is a force that impacts the at least one roller, m is a mass of the at least one roller, f(x) is a vector distance from a zero point of the at least one roller, f(v) is a vector velocity of the at least one roller and f(a) is a vector acceleration of the at least one roller, k is a stiffness of the grinding bed, and c is a damping of the at least one roller and therefrom continuously determining the stiffness k or damping c of the grinding bed.

2. The method according to claim 1, wherein the mechanical condition of the at least one roller includes at least one of a force imparted by the grinding bed onto the at least one roller and a location and a rotation angle of the at least one roller about a rotation axis of the at least one roller.

3. The method according to claim 2, wherein at least one of the force and the location is determined at least in a radial direction of the at least one roller.

4. The method according to claim 2, wherein at least one of velocity, acceleration, angular velocity and angular acceleration of the at least one roller is determined.

5. The method according to claim 1, wherein the stiffness k and damping c of the grinding bed are continuously determined.

6. The method according to claim 1, wherein calibration is initially performed by determining proportional constants based on measured values by multiple non-linear regression, and wherein the proportional constants are used for determining the control variables from the stiffness k or damping c of the grinding bed.

7. The method according to claim 6, wherein the proportional constants are continuously determined during the grinding.

8. The method according to claim 1, wherein water is introduced together with the grinding material between the grinding element and the at least one roller, and wherein the control variables include an amount of the introduced water.

9. The method according to claim 1, wherein the grinding material is fed into a sifter after grinding by essentially vertically flowing air, wherein the grinding material is classified in the sifter, and wherein the control variables include an amount of the flowing air and a rotation speed of the sifter.

10. The method according to claim 1, wherein the damping c of the grinding bed is continuously determined.

11. The method according to claim 1, wherein the stiffness k of the grinding bed is continuously determined.

* * * * *